United States Patent [19]

Brandin

[11] 4,004,811

[45] Jan. 25, 1977

[54] WORD GAME APPARATUS

[76] Inventor: Henry Brandin, 232 N. Milwaukee Ave., Wheeling, Ill. 60090

[22] Filed: Jan. 24, 1975

[21] Appl. No.: 543,831

[52] U.S. Cl. ..... 273/135 D; 273/144 A

[51] Int. Cl.[2] ..... A63F 3/06

[58] Field of Search .... 273/130 E, 131 G, 134 AB, 273/135 R, 135 D, 136 W, 144, 135 AC, 134 C

[56] References Cited

UNITED STATES PATENTS

| | | | |
|---|---|---|---|
| 265,100 | 9/1882 | Kehoe et al. | 273/144 A |
| 840,934 | 1/1907 | Grant | 273/144 A |
| 1,512,147 | 10/1924 | Tegtmeyer et al. | 273/135 D |
| 1,661,711 | 3/1928 | Vaughan | 273/135 AC |
| 2,086,296 | 7/1937 | Gilbert | 273/144 A |
| 2,902,284 | 9/1959 | Massaro | 273/144 A |
| 3,116,927 | 1/1964 | Kuhlman | 273/135 D |
| 3,215,435 | 11/1965 | Rheingruber | 273/134 AB |
| 3,423,872 | 1/1969 | Dodson | 273/144 B |
| 3,531,121 | 9/1970 | Anderson et al. | 273/134 C |

*Primary Examiner*—Anton O. Oechsle
*Assistant Examiner*—Harry G. Strappello
*Attorney, Agent, or Firm*—Hill, Gross, Simpson, Van Santen, Steadman, Chiara & Simpson

[57] ABSTRACT

A word game using lettered objects, letter selection devices and combination boards, and a set of rules, suitable for audience entertainment, testing and comparing the luck and skill of participants in drawing random combinations of lettered objects which consecutively or in rearranged order form recognized words. Rewards of fixed size and chances at further rewards of variable sizes are won by obtaining letters in consecutive order and, if no consecutive word order is obtained, for rearranging letters into word order, the rewards, either points or cash or prizes, increasing for words formed from greater numbers of letters. Alphabetical orders of letters drawn may also be recognized and rewarded.

4 Claims, 6 Drawing Figures

Fig. 1
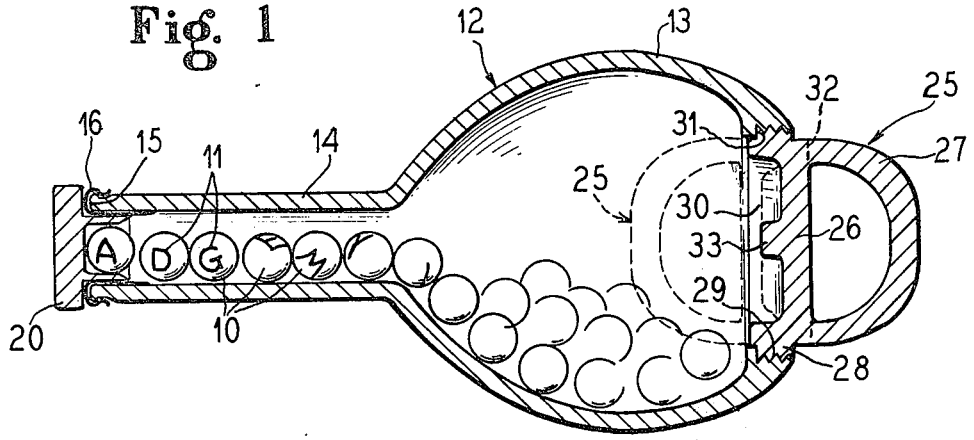
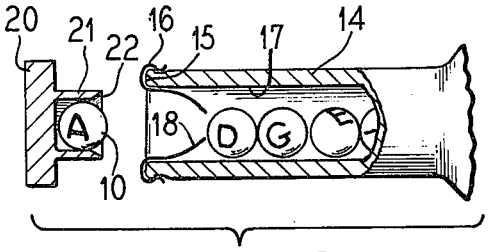
Fig 2
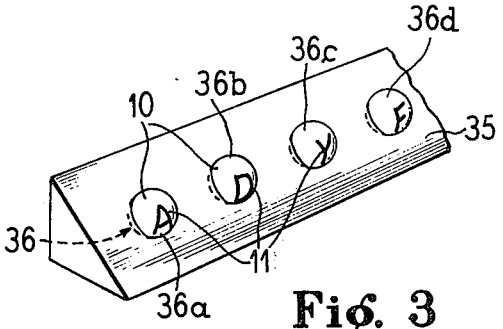
Fig. 3
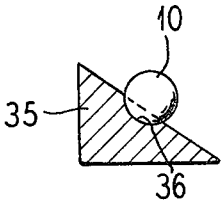
Fig. 4
Fig. 5
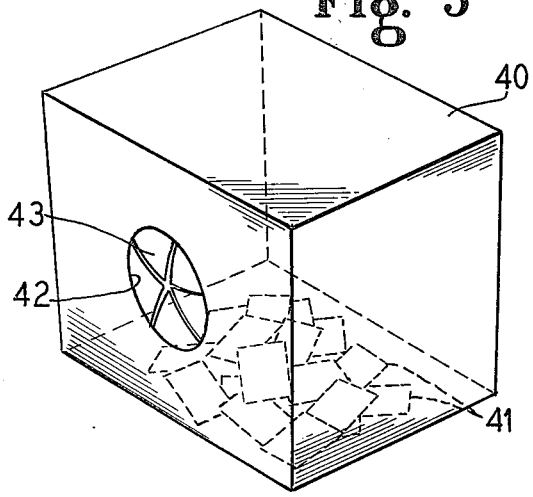
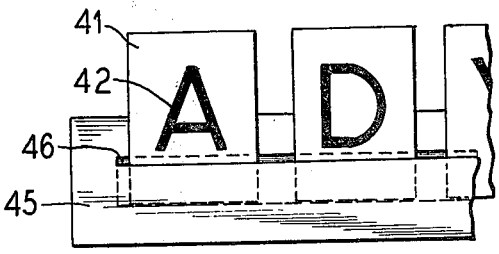
Fig. 6

WORD GAME APPARATUS

BACKGROUND OF THE INVENTION

1. Field of the Invention

This invention relates to new apparatus and methods employed in a game of luck and skill in recognizing and forming combinations of letters which form words, the game being suitable for audience entertainment.

2. Description of the Prior Art

Games involving the combination of randomly drawn letters into word order are both old and popular, for home recreation as well as for such audience entertainment as television programs. "Scrabble" is a well known home or family game, involving the drawing by each of several players of a number of lettered squares from a container and in turn arranging some or all of the letters in interlocking crossword-puzzle fashion with other letters and words on a board, with each letter having a point value and certain spaces on the board having multiple values.

One current television game involves contestants picking words from a board on which numerous letters are displayed in grid fashion, the words being formed by moving up, down, to the right or left, or diagonally, from one letter to the next successive letter, and the words identified by clues or suggestions made to the contestant as to correct answers. Prizes are awarded for each word identified.

SUMMARY OF THE INVENTION

In accordance with the principles of the present invention, a plurality of objects identical to one another except for each object having a different letter of the English alphabet imprinted on a surface thereof are placed in a unique container for each participant in the game. Each container contains a complete set of the lettered objects, which may be an entire alphabet or a mixture of letters in varying proportions, and obscures the letters thereon so that the individual objects may be randomly drawn or dispensed. The objects may be lettered balls or cards, and the container a special flask or a box of sufficient size to contain the complete set of objects. Each participant has a board or rack on which he may place his objects with their letters displayed. The participant places the letters on his board first in their consecutive order to determine if a word is formed thereby, and then he may rearrange them in any order to form a word combination. This rearrangement may be attempted after each object is drawn or after a certain number of objects are drawn. A set of rules is provided for ordering rewards, which may be points or cash or prizes, for obtaining or effecting combinations of letters, depending on the lengths of the words formed. Also in accordance with the principles of the invention, various alphabetical segments or orders of letters may be recognized and rewarded. Provisions may be made for audience participation, including selection of game participants therefrom as well as to provide multiple participants for each combination of letters, as through a panel arrangement with competition among members of the panel.

BRIEF DESCRIPTION OF THE DRAWINGS

FIG. 1 shows a container of one embodiment of apparatus used in the game of this invention, in longitudinal cross-section and partially filled with lettered objects.

FIG. 2 is a detailed view of a portion of the neck of the flask of FIG. 1 with a stopper removed from the end thereof, and a spring collar on the neck being expanded to constrict the neck of the flask to prevent egress of more than one object.

FIG. 3 is a perspective view of a board which may be used with spherical lettered objects in practicing the game of the present invention.

FIG. 4 is a cross-sectional view of the rack of FIG. 3, showing a recess in a face thereof in which one of the lettered objects may be placed.

FIG. 5 shows a hollow box which may be employed to contain lettered cards in an alternative embodiment of the apparatus for the present invention.

FIG. 6 shows in plan view a rack employed with the cards used in the embodiment of FIG. 5.

DESCRIPTION OF THE PREFERRED EMBODIMENTS

The present invention employs a number of unique but simple impliments in addition to a set of rules for testing and rewarding the luck and skill of two or more players in forming words and alphabetical combinations from individually lettered objects dispensed or selected at random from closed containers. Apparatus employed in the game comprises generally a container in which a number of objects are placed, each of the objects being identical except for a letter of the alphabet being inscribed in or on a surface of each of the objects. The objects or letters are drawn or selected in random order from the container by each participant and arranged on a rack or board in the order drawn. The lettered objects may be rearranged on each board from the order of draw to form words and letter combinations in accordance with a standard reference dictionary or rules provided. Rewards consisting of point values or cash awards and opportunities to draw prizes from prize boards are given. Various methods for obtaining or allowing audience participation may also be provided.

As shown in FIG. 1, a plurality of objects 10 such as spheres or balls each inscribed with a letter 11 of the English alphabet are contained within a container 12 formed in the shape of a flask. The letters 11 on the identical objects 10 may comprise a complete alphabet, A, B, C . . . X, Y, Z, or may be any combination of those letters, or some of them, or may be provided in varying proportions, such as five of each of the vowels, four S's, no Q or Z, etc.

The flask 12 has an enlarged or bulbous portion 13 of sufficient volume to contain an entire set of the objects 10. The flask 12 also has a narrow, elongated neck portion 14 communicating with the bulbous portion 13 and terminating in an opening 15. The neck portion 14 has an internal diameter sufficient to allow formation of only a single file or row of objects 10 in the neck 14 inwardly of the opening 15.

The opening 15 is fitted with a spring collar 16 which irremoveably engages an outer surface of the neck 14, covers the edge 15, and extends into the interior of the neck adjacent an interior wall 17 of the neck 14 at a normally radially constricted annulus 18, the annulus having an opening insufficient to pass any of the objects 10 from within the flask.

A stopper 20 is received in the neck 14 of the flask 12 by a cylindrical portion 21 which slidably engages the spring collar 16 inwardly of the neck 14. The cylindrical portion 21 of the stopper 20 has an internal diameter sufficient to receive therein one of the objects 10, and a length sufficient to depress the constricted annulus 18 of the spring collar 16 against the walls 17 of the neck 14 when the stopper 20 is inserted into the neck 14 as shown in FIG. 1. The free edge 22 of the cylindrical portion 21 of the stopper 20 may be beveled as shown in FIG. 2 to facilitate the guidance of a ball 10 into the cap 20 for removal.

The flask 12 of the present invention is also provided with a handle assembly 25 at an end of the bulbous portion 13 opposite the neck 14. The handle assembly 25 comprises a circular cover portion 26 and a manually-grippable handle 27 attached thereto at its ends and having a center portion spaced from the cover 26, and a threaded cylindrical portion 28 about the cover 26 which engages sidewalls 29 of the opening 30. The handle assembly 25 provides means both for agitating the flask 12 and shaking the contents 10 thereof, as well as providing an opening in the flask 12 by which the objects 10 may be placed into and removed from the flask 12 in bulk rather than one-by-one through the neck 14 via the spring collar 16.

It is also a feature of the invention that the handle assembly 25 may be reversably engated in the threads 29 in the flask 12, with the handle 27 inserted within the bulbous portion 13 and the threaded portion 28 of the handle 25 screwed into the threads 29 and against a shoulder 31 of the threaded portion 29 to create a flat and unobstructed annular surface 32 on which the flask 12 may rest with the neck 14 in upright position. A grippable bar 33 is provided within the recess of the cover 26 opposite the handle 27 to allow the user of the flask to obtain purchase on the inverted handle assembly 25 to screw it into the flask.

Objects 10 removed from the flask 12 may be placed upon a special rack 35 having spherical indentations 36 on a face thereof to receive the objects 10 with the letters 11 on each one exposed for view. Thus, each object 10 as it is removed from the stopper 20 may be placed upon the rack 35 from left to right in the order of draw. After each draw, the objects 10 may be freely rearranged among the indentations **36*a*, 36*b*, 36*c*, 36*d***, etc., to display alternate letter combinations in an effort to form words or alphabetical combinations in accordance with rules of the game.

FIGS. 5 and 6 show an alternate embodiment of the container and rack useable in accordance with the principles of the game. The container comprises a hollow box 40 of sufficient size to hold a complete set of objects 41 each having a letter of the alphabet 42 thereon. An aperture 42 is formed in one surface of the box 40 and is fitted with a flexible closure member 43 to conceal the contents of the box. The aperture 42 and the closure member 43 allow passage of a hand of a participant and exit of the hand containing one or more of the cards or other objects 41. A rack 45 is provided with this embodiment of the device, having a slot 46 formed in an upper surface of the rack in which the cards or objects 41 may be placed and manipulated in similar manner to the objects 10 in the rack 35.

In operation, a set of lettered objects 10 or 41 may be placed within the container 12 or 40 for each participant, each set comprising an entire alphabet or portion thereof or a mixture of letters in varying proportions. Each participant will initially draw two letters, in random order, from each container used, place them on his rack 35 or 45, and examine them to determine if a word is formed in the order drawn. If no word is formed, a third letter is drawn and the examination process is repeated. Fourth, fifth, and further lettered objects may be drawn until one of the participants draws or can rearrange letters to form a word. Whether any combination of letters forms a word may be determined by reference to a dictionary or other work selected in advance.

It is also in accordance with the principles of the current invention to recognize alphabetical combinations of letters, such as A-B-C-D-E, as having point or prize values reflecting the luck of the draw. In this respect interactions among players may be recognized also, such as drawing the letter which is alphabetically before or after a letter drawn by another contestant for two or more draws.

As a family game, point values may be awarded to players being able to form words from given numbers of letters, with deductions for discarded letters. Variable points may also be obtained, similarly to the prize boards described below. In an audience participation format such as a television game, a series of valuable prizes may be determined, comprising cash bonuses plus use of two prize selection boards. A first prize board has selections representing hidden cash values or merchandise of relatively low amounts, and a similar second prize board has relatively higher values.

Rules for ordering rewards may be:

1. Where less than four lettered objects have been drawn and the letters on those objects form a word of more than one letter in the order drawn, the participant may draw a prize from the first prize board and also receive a reward of relatively small size proportioned to the number of letters in his word;
2. Where more than three objects have been drawn and the letters thereon form a word of more than three letters in the order drawn, the participant may select from the second prize board and receive a relatively high reward proportioned to the number of letters in his word;
3. Where from two to five objects have been drawn and less than all the objects may be rearranged from their consecutive order to form a word with the letters thereon, the participant may select from the first prize board;
4. Where five objects have been drawn and can be rearranged from their consecutive order to form a word using all the letters on the objects, the participant may select a prize from the first board and receive a cash or point reward;
5. Where more than five objects have been drawn and may be rearranged from their consecutive order to form a word using all the letters thereon, the participant may select from the second prize board and receive a substantial reward approximately half the size of that given when a word is formed from letters on the objects in their consecutive order;
6. Where between five and nine objects have been drawn and all but one may be rearranged from their consecutive order to form a word, the participant may select from the second prize board to receive a substantial reward; and
7. Where more than eight objects have been drawn and all but two of the objects may be rearranged to form a word with the letters thereon, the participant may select from the second prize board or receive a substantial reward.

Variations in these recognitions of luck in drawing word combinations of letters and in rearranging letters to form words may of course be made without departing from the spirit of the invention disclosed herein.

Further, although various modifications might be suggested in the structures employed by those versed in the relevant art, it should be understood that I wish to embody within the scope of the patent warranted hereon all such modifications as reasonably and properly come within the scope of my contribution to the art.

I claim:

1. An apparatus for use in a game of luck and skill among a plurality of participants, in which word combinations are to be made from letters randomly drawn, the apparatus comprising:

a plurality of solid objects identical to one another except for each object having a letter imprinted on a surface thereof, which is different from other letters imprinted on others of said objects;

an opaque flask having a narrow neck, and containing a set of said objects and obscuring the letters thereon, from which individual objects may be selectively and randomly dispensed in a sequence;

a board on which each participant may place his lettered objects with their letters displayed; and said flask having a handle on its outer surface opposite said neck, whereby the flask and contents may be held and agitated.

2. An apparatus as defined in claim 1, wherein the flask neck comprises:

surfaces defining an opening;

a stopper fitting into said opening;

a spring collar about the opening and extending thereinto and forming an expansible, normally radially restricted annulus therein having a diameter normally insufficient to pass a lettered object; and the stopper having a cylindrical portion with an inner diameter and length sufficient to accept one of said lettered objects into said cylindrical portion, and said portion having an outer diameter sufficient to engage the spring collar within the flask neck and to expand the constricted annulus thereof when said stopper is inserted into said neck, thereby to pass one of said lettered objects into said cylindrical portion for extraction from said flask upon removal of said stopper from said flask after inversion of said flask to direct an object into said neck and to the stopper.

3. An apparatus as defined in claim 1, the flask further comprising:

a bulbous portion with sufficient capacity therein to hold the plurality of lettered objects and having communication with the neck of the flask;

the bulbous portion having surfaces defining an opening therein opposite said neck;

the surfaces being screw-threaded to engage a circular cover having a correspondingly threaded outer portion and which may be rotated into sealing engagement with said surfaces of said flask;

the cover having a diameter sufficient to pass several of said lettered objects simultaneously; and the cover having integrally formed thereon said handle.

4. An apparatus as defined in claim 3, wherein the cover is reversibly threadable into said opening of said bulbous portion of said flask, to position the handle inside said flask, so that the flask may be set on a flat surface of said cover opposite said handle, with the neck portion of the flask standing upright.

* * * * *